US009097196B2

(12) United States Patent
Buslepp et al.

(10) Patent No.: US 9,097,196 B2
(45) Date of Patent: Aug. 4, 2015

(54) STOCHASTIC PRE-IGNITION DETECTION SYSTEMS AND METHODS

(75) Inventors: Kenneth J. Buslepp, Brighton, MI (US); Daniel G. Brennan, Brighton, MI (US); Julian R. Verdejo, Farmington, MI (US); David S. Mathews, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 841 days.

(21) Appl. No.: 13/222,503

(22) Filed: Aug. 31, 2011

(65) Prior Publication Data

US 2013/0054109 A1 Feb. 28, 2013

(51) Int. Cl.

| | |
|---|---|
| ***F02D 28/00*** | (2006.01) |
| ***F02D 41/14*** | (2006.01) |
| ***F02D 41/00*** | (2006.01) |

(52) U.S. Cl.

CPC ..... *F02D 41/1497* (2013.01); *F02D 41/009* (2013.01); *F02D 2041/1417* (2013.01)

(58) Field of Classification Search

CPC ..... F02D 41/009; F02D 41/1497; F02D 41/1498; F02D 2200/1012; F02D 35/02; F02D 35/027; G01L 23/225; G01M 15/11; G01M 15/12; Y02T 10/40

USPC ..... 123/436; 73/114.02, 114.03, 73/114.24–114.26, 35.01; 701/101, 102, 701/111

See application file for complete search history.

(56) References Cited

U.S. PATENT DOCUMENTS

| | | | | |
|---|---|---|---|---|
| 3,923,021 | A | 12/1975 | Stark | |
| 4,233,943 | A * | 11/1980 | Rogora et al. | 123/406.26 |
| 4,525,781 | A | 6/1985 | Konomi et al. | |
| 4,587,938 | A | 5/1986 | Kobayashi et al. | |
| 4,658,787 | A | 4/1987 | Takizawa | |
| 4,691,677 | A | 9/1987 | Hotate et al. | |
| 4,716,873 | A | 1/1988 | Takaba et al. | |
| 4,730,587 | A | 3/1988 | Norota et al. | |
| 4,760,825 | A | 8/1988 | Morita | |
| 4,763,264 | A | 8/1988 | Okuno et al. | |

(Continued)

FOREIGN PATENT DOCUMENTS

| | | | |
|---|---|---|---|
| CN | 1204003 | A | 1/1999 |
| CN | 101074634 | A | 11/2007 |

(Continued)

OTHER PUBLICATIONS

U.S. Appl. No. 13/775,628, filed Feb. 25, 2013, Gwidt et al.

(Continued)

*Primary Examiner* — Mahmoud Gimie
*Assistant Examiner* — John Zaleskas

(57) ABSTRACT

A system for a vehicle includes a time stamping module, a period determination module, a stochastic pre-ignition (SPI) indication module, and an SPI remediation module. The time stamping module generates first and second timestamps when a crankshaft of an engine is in first and second crankshaft positions during an engine cycle, respectively. The period determination module determines a period between the first and second timestamps. The SPI indication module selectively indicates that an SPI event occurred within a cylinder of the engine based on the period. The SPI remediation module selectively adjusts at least one engine operating parameter in response to the SPI indication module indicating that the SPI event occurred within the cylinder.

12 Claims, 5 Drawing Sheets

(56) References Cited

U.S. PATENT DOCUMENTS 4,788,942 A 12/1988 Pouring et al.
4,915,076 A 4/1990 Takizawa
4,919,096 A 4/1990 Manaka et al.
5,005,547 A 4/1991 Suga et al.
5,046,468 A 9/1991 Erhard
5,074,810 A 12/1991 Hobbs et al.
5,107,813 A 4/1992 Inoue et al.
5,110,310 A 5/1992 Hobbs
5,229,945 A 7/1993 Demizu et al.
5,408,863 A 4/1995 Sawyers et al.
5,477,826 A 12/1995 Hara et al.
5,632,247 A * 5/1997 Hashizume et al. ..... 123/406.26
5,699,253 A 12/1997 Puskorius et al.
5,700,171 A 12/1997 Horton
5,715,794 A 2/1998 Nakamura et al.
5,732,382 A 3/1998 Puskorius et al.
5,751,147 A * 5/1998 Nakata et al. ..... 324/399
5,765,528 A 6/1998 Kamimaru
5,771,482 A 6/1998 Rizzoni
5,905,193 A * 5/1999 Hashizume et al. ..... 73/35.09
6,023,651 A * 2/2000 Nakayama et al. ..... 701/110
6,085,143 A 7/2000 Przymusinski et al.
6,109,986 A 8/2000 Gaynor et al.
6,415,656 B1 7/2002 Bidner et al.
6,485,341 B1 11/2002 Lanyi et al.
6,668,812 B2 12/2003 Javaherian
6,672,282 B2 1/2004 Harrison et al.
6,691,653 B2 2/2004 Denz
6,752,009 B2 6/2004 Minich et al.
6,757,606 B1 6/2004 Gonring
6,758,179 B1 7/2004 McKay et al.
6,866,024 B2 3/2005 Rizzoni et al.
6,999,868 B2 2/2006 Funke et al.
7,024,304 B2 4/2006 Fukasawa et al.
7,047,125 B1 5/2006 He et al.
7,047,924 B1 5/2006 Waters et al.
7,063,057 B1 6/2006 Waters et al.
7,117,080 B2 10/2006 Sobel
7,133,766 B2 * 11/2006 Kokubo ..... 701/114
7,146,851 B2 12/2006 Wakahara et al.
7,167,789 B1 1/2007 Froloff et al.
7,178,503 B1 2/2007 Brehob
7,197,916 B2 * 4/2007 Matsumoto et al. ..... 73/114.04
7,214,110 B1 5/2007 Ehlers et al.
7,243,532 B2 7/2007 Tsujimura et al.
7,246,583 B2 7/2007 Cinpinski et al.
7,251,557 B2 7/2007 Strom et al.
7,325,446 B1 2/2008 Assaf et al.
7,353,803 B2 * 4/2008 Mathews et al. ..... 123/406.18
7,361,067 B1 4/2008 Smedema
7,437,233 B2 10/2008 Yasui et al.
7,444,236 B2 10/2008 Wiles
7,451,739 B2 11/2008 Yasui et al.
7,469,678 B2 12/2008 Ruiz
7,500,470 B2 3/2009 Buslepp et al.
7,526,943 B2 5/2009 Cubr et al.
7,530,261 B2 5/2009 Walters
7,607,415 B2 10/2009 Mathews et al.
7,623,955 B1 11/2009 Rackmil et al.
7,654,248 B2 2/2010 Buslepp et al.
7,665,558 B2 * 2/2010 Akimoto et al. ..... 180/65.28
7,685,996 B2 3/2010 Brehob
7,698,935 B2 4/2010 Dibble et al.
7,784,443 B2 8/2010 Hitomi et al.
7,861,689 B2 * 1/2011 Haug et al. ..... 123/406.21
7,877,174 B2 1/2011 Walser et al.
7,918,212 B2 4/2011 Verdejo et al.
8,027,782 B2 9/2011 Assaf et al.
8,176,896 B2 5/2012 Verdejo et al.
8,245,692 B2 8/2012 Glugla et al.
8,251,043 B2 8/2012 Smith
8,261,603 B2 9/2012 Kondo et al.
8,307,808 B2 11/2012 Kaiser et al.
8,387,384 B2 3/2013 Quigley et al.
8,392,096 B2 3/2013 Mathews et al.
8,478,511 B2 7/2013 Hamama et al.
8,532,908 B2 9/2013 Morgan et al.
8,612,124 B2 12/2013 Verdejo et al.
2002/0157639 A1 10/2002 Kidokoro et al.
2004/0153286 A1 8/2004 Yamada
2004/0236496 A1 11/2004 Sobel
2005/0039721 A1 2/2005 Truscott et al.
2005/0056240 A1 3/2005 Sugiyama et al.
2005/0121005 A1 6/2005 Edwards
2005/0204805 A1 9/2005 Wakahara et al.
2006/0112933 A1 6/2006 Yasui et al.
2006/0124107 A1 6/2006 Sauler et al.
2006/0241848 A1 10/2006 Strom et al.
2006/0254560 A1 11/2006 Mann et al.
2006/0293827 A1 12/2006 Frauenkron et al.
2007/0068474 A1 3/2007 Cinpinski et al.
2007/0119391 A1 5/2007 Fried et al.
2007/0233430 A1 10/2007 Singh
2007/0239343 A1 10/2007 Okubo et al.
2007/0295290 A1 12/2007 Cao
2008/0006244 A1 * 1/2008 Asano et al. ..... 123/478
2008/0028387 A1 1/2008 Nakagawa et al.
2008/0077307 A1 3/2008 Wiles
2008/0178844 A1 * 7/2008 Naegele et al. ..... 123/436
2008/0183367 A1 * 7/2008 Kapus et al. ..... 701/103
2008/0283025 A1 11/2008 Sato
2008/0312810 A1 12/2008 Nonoyama
2009/0048729 A1 2/2009 Waters et al.
2009/0090106 A1 4/2009 Muller
2009/0192693 A1 7/2009 Bottcher et al.
2009/0215331 A1 8/2009 Suzuki et al.
2009/0223495 A1 9/2009 Ohata et al.
2009/0229568 A1 9/2009 Nakagawa
2009/0276142 A1 11/2009 Leone et al.
2009/0276143 A1 11/2009 Rackmil et al.
2009/0276147 A1 11/2009 Hamama et al.
2010/0012079 A1 1/2010 Nakazono et al.
2010/0037859 A1 2/2010 Mashiki
2010/0063712 A1 3/2010 Bromberg et al.
2010/0083936 A1 * 4/2010 Verdejo et al. ..... 123/406.65
2010/0088010 A1 * 4/2010 Verdejo et al. ..... 701/105
2010/0089361 A1 4/2010 Inada et al.
2010/0094528 A1 * 4/2010 Auclair et al. ..... 701/111
2010/0152990 A1 6/2010 Bjernetun et al.
2010/0152991 A1 * 6/2010 Suzuki ..... 701/99
2010/0192905 A1 8/2010 Lewis et al.
2010/0294027 A1 * 11/2010 Kondo et al. ..... 73/114.02
2011/0067396 A1 3/2011 Quigley et al.
2011/0088468 A1 * 4/2011 Mayhew ..... 73/488
2011/0139120 A1 6/2011 Rollinger et al.
2011/0224882 A1 * 9/2011 Makino et al. ..... 701/102
2011/0246049 A1 * 10/2011 Matsuo et al. ..... 701/111
2011/0253100 A1 10/2011 Kaiser et al.
2011/0265761 A1 11/2011 Amann et al.
2011/0283972 A1 11/2011 Wermuth et al.
2012/0048234 A1 3/2012 Hamama et al.
2012/0078485 A1 3/2012 Verdejo et al.
2012/0191275 A1 7/2012 Clever et al.
2012/0191276 A1 7/2012 Clever et al.
2012/0191277 A1 7/2012 Clever et al.
2012/0209494 A1 8/2012 Verdejo et al.
2013/0047956 A1 2/2013 Davis

FOREIGN PATENT DOCUMENTS

CN 101331305 A 12/2008
DE 102007024415 B3 * 1/2009 ..... F02D 35/02
DE 102009008247 B3 * 8/2010 ..... F02D 41/22
JP 2009174397 A 8/2009
JP 2009275663 A * 11/2009
JP 2011012607 A * 1/2011

OTHER PUBLICATIONS

U.S. Appl. No. 12/478,159, filed Jun. 4, 2009, Verdejo et al.
U.S. Appl. No. 12/762,516, filed Apr. 19, 2010, Kaiser et al.
U.S. Appl. No. 13/590,351, filed Aug. 21, 2012, Betz.
U.S. Appl. No. 13/590,369, filed Aug. 21, 2012, Betz.
Chinese Search Report dated Sep. 27, 2012 for Chinese Application

(56) References Cited

OTHER PUBLICATIONS

No. CN201110097845.3, (2 pages).
U.S. Appl. No. 12/357,776, filed Jan. 22, 2009, J. Verdejo et al.
U.S. Appl. No. 12/762,523, filed Apr. 19, 2010, D. Mathews et al.
U.S. Appl. No. 12/984,818, filed Jan. 5, 2011, J. Verdejo et al.
U.S. Appl. No. 13/024,726, filed Feb. 10, 2011, J. Verdejo et al.
U.S. Appl. No. 13/118,985, filed May 31, 2011, J. Morgan et al.
O'Reilly Auto Parts; Possible Cause of Engine Misfire: http://oreillyauto.com/site/app/newsfeed/detail?article=800649141; Nov. 23, 2011.

* cited by examiner

STOCHASTIC PRE-IGNITION DETECTION SYSTEMS AND METHODS

FIELD

The present disclosure is related to internal combustion engines and more particularly to stochastic pre-ignition (SPI) in internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine control systems monitor a position of a crankshaft of an engine. Rotational speed of the crankshaft (engine speed) and crankshaft acceleration can be determined based on the crankshaft position. For example only, fueling, ignition timing, throttle opening, and/or other engine parameters may be controlled based on the crankshaft position, the engine speed, and/or the acceleration.

A crankshaft position monitoring system typically includes a control module (e.g., an engine control module), a crankshaft position sensor, and a toothed wheel that rotates with the crankshaft. The toothed wheel may have N number of teeth, and the crankshaft position sensor may monitor passing of the teeth. The crankshaft position sensor generates pulses in a crankshaft position signal as the teeth of the toothed wheel pass the crankshaft sensor.

The control module determines the crankshaft position based on the pulses in the crankshaft position signal. The control module may determine the crankshaft position at various crankshaft rotation intervals. As an example, the control module may determine the crankshaft position at intervals of greater than or equal to 90° of crankshaft rotation. The resolution of the crankshaft position signal (e.g., number of samples per crankshaft revolution) may increase as the intervals decrease.

SUMMARY

A system for a vehicle includes a time stamping module, a period determination module, a stochastic pre-ignition (SPI) indication module, and an SPI remediation module. The time stamping module generates first and second timestamps when a crankshaft of an engine is in first and second crankshaft positions during an engine cycle, respectively. The period determination module determines a period between the first and second timestamps. The SPI indication module selectively indicates that an SPI event occurred within a cylinder of the engine based on the period. The SPI remediation module selectively adjusts at least one engine operating parameter in response to the SPI indication module indicating that the SPI event occurred within the cylinder.

A method for a vehicle includes: generating first and second timestamps when a crankshaft of an engine is in first and second crankshaft positions during an engine cycle, respectively; determining a period between the first and second timestamps; selectively indicating that a stochastic pre-ignition (SPI) event occurred within a cylinder of the engine based on the period; and selectively adjusting at least one engine operating parameter in response to the indication that the SPI event occurred within the cylinder.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
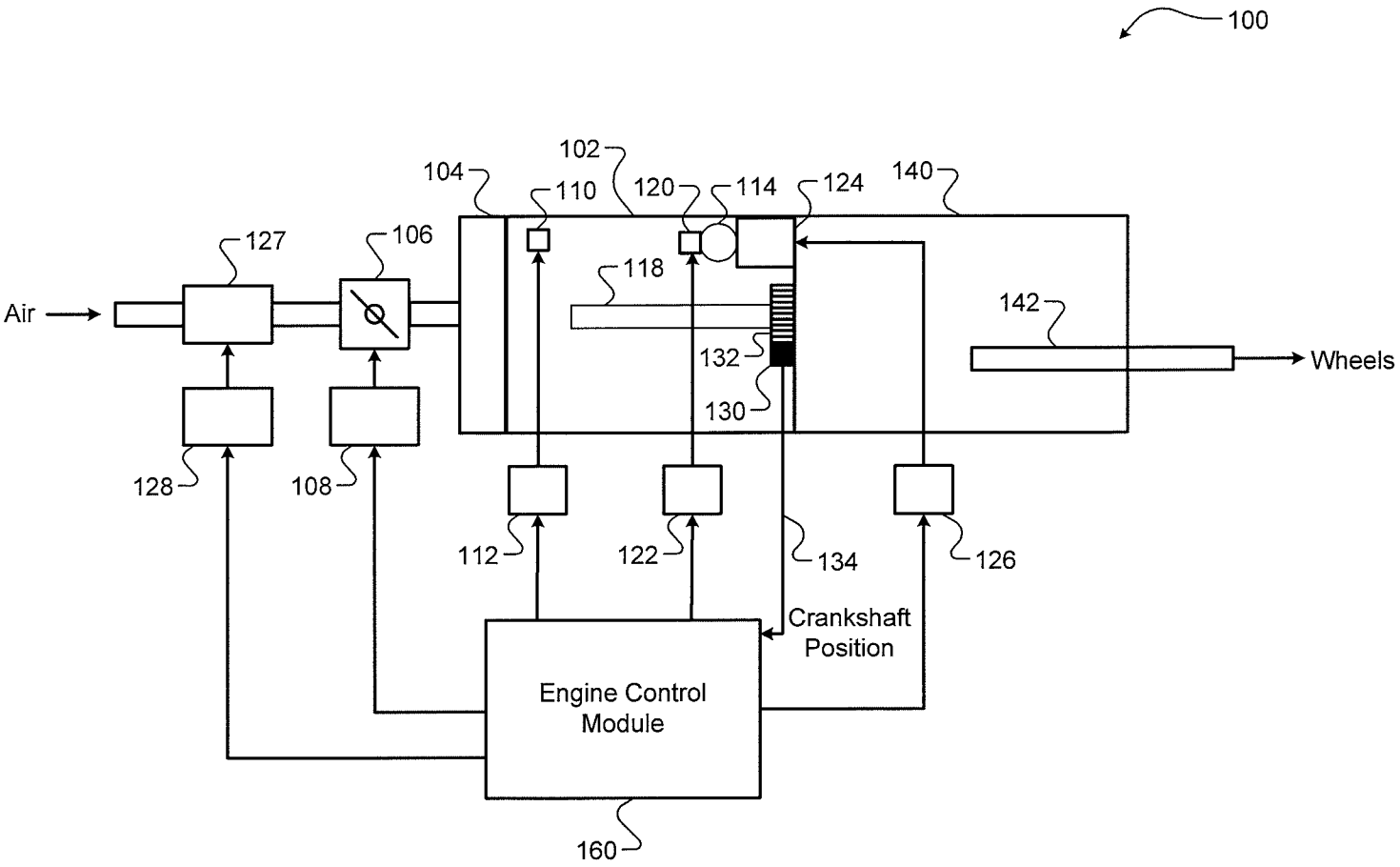
FIG. 1 is a functional block diagram of an example vehicle system according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors or a group of execution engines. For example, multiple cores and/or multiple threads of a processor may be considered to be execution engines. In various implementations, execution engines may be grouped across a processor, across multiple processors, and across processors in multiple locations, such as multiple servers in a parallel processing arrangement. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

A crankshaft position sensor generates pulses in a crankshaft position signal as teeth of an N-toothed wheel pass the crankshaft position sensor. The N-toothed wheel rotates with a crankshaft of an engine. The N-toothed wheel may have space for, for example, 60 equally spaced teeth (i.e., N=60). The N-toothed wheel may include 58 teeth that are approximately equally spaced and a gap where 2 approximately equally spaced teeth are missing. Accordingly, a given point (e.g., an edge) of each of the teeth (including the missing teeth) may be separated by a rotational distance of approximately 6° (360°/60=6°).

A control module, such as an engine control module (ECM), determines various parameters based on the crankshaft position signal. For example only, the ECM may determine the crankshaft position based on the number of pulses detected in the crankshaft position signal. The ECM may also determine a period between two pulses (corresponding to two teeth) and determine a rotational speed of the crankshaft based on the period between the two pulses and the rotational distance between the two teeth. The ECM may also determine an acceleration and one or more other parameters based on the crankshaft position.

Under some circumstances, a stochastic pre-ignition (SPI) event may occur within a cylinder of the engine. For example only, SPI may occur when the engine speed is less than a predetermined speed (e.g., approximately 3000 revolutions per minute) and an engine load is greater than a predetermined load.

The ECM of the present disclosure generates timestamps when pulses are detected in the crankshaft position signal. The ECM determines periods between consecutive timestamps and determines delta periods (change in period) between consecutive periods. The ECM selectively indicates whether an SPI event occurred within a cylinder of the engine based on the delta periods. More specifically, the ECM selectively indicates whether an SPI event occurred within a cylinder based on a delta period difference caused by a sudden one event change in cylinder pressure at a given piston position.

Referring now to FIG. 1, a functional block diagram of an example vehicle system 100 is presented. An engine 102 generates torque for a vehicle. Air is drawn into the engine 102 through an intake manifold 104. Airflow into the engine 102 may be varied by a throttle valve 106. A throttle actuator module 108 (e.g., an electronic throttle controller) controls opening of the throttle valve 106. One or more fuel injectors, such as fuel injector 110, mix fuel with the air to form a combustible air/fuel mixture. A fuel actuator module 112 controls the fuel injector(s).

A cylinder 114 includes a piston (not shown) that is coupled to a crankshaft 118. Although the engine 102 is depicted as including only the cylinder 114, the engine 102 may include more than one cylinder. One combustion cycle of the cylinder 114 may include four strokes: an intake stroke, a compression stroke, an expansion stroke, and an exhaust stroke. One engine cycle includes each of the cylinders undergoing one combustion cycle.

During the intake stroke, the piston approaches a bottom most position, and the air and fuel may be provided to the cylinder 114. The bottom most position may be referred to as a bottom dead center (BDC) position. During the compression stroke, the crankshaft 118 drives the piston toward a top most position and compresses the air/fuel mixture within the cylinder 114. The top most position may be referred to as a top dead center (TDC) position. A spark plug 120 may ignite the air/fuel mixture in various types of engines. A spark actuator module 122 controls the spark plug 120.

Combustion of the air/fuel mixture drives the piston away from the TDC position during the expansion stroke and rotatably drives the crankshaft 118. The rotational force (i.e., torque) may be a source of compressive force for a compression stroke of a combustion cycle of one or more cylinders that follow the cylinder in a predetermined firing order. Exhaust gas resulting from the combustion of the air/fuel mixture is expelled from the cylinder 114 during the exhaust stroke.

A camshaft phaser 124 may control opening of the intake and/or exhaust valve(s) of the cylinder 114. More specifically, the camshaft phaser 124 controls rotation of a camshaft (not shown) to control opening of the intake and/or exhaust valve(s). A phaser actuator module 126 controls the camshaft phaser 124.

One or more boost devices, such as boost device 127, may be implemented in various implementations. The boost device(s) are omitted in naturally aspirated engine systems. The boost device 127 may include, for example, a turbocharger or a supercharger. The boost device 127 may increase pressure within the intake manifold 104. A boost actuator module 128 controls the boost device 127. Boost may be described as an amount that the pressure within the intake manifold 104 is greater than ambient pressure.

A crankshaft position sensor 130 monitors an N-toothed wheel 132 and generates a crankshaft position signal 134 based on rotation of the N-toothed wheel 132. For example only, the crankshaft position sensor 130 may include a variable reluctance (VR) sensor, a hall-effect, or another suitable type of crankshaft position sensor. The N-toothed wheel 132 rotates with the crankshaft 118. The N-toothed wheel 132 includes space for N equally spaced teeth.

The crankshaft position sensor 130 generates a pulse in the crankshaft position signal 134 each time that a tooth of the N-toothed wheel 132 (e.g., rising or falling edge of the tooth) passes the crankshaft position sensor 130. Accordingly, each pulse in the crankshaft position signal 134 may correspond to an angular rotation of the crankshaft 118 by an amount equal to 360° divided by N.

For example only, the N-toothed wheel 132 may include space for 60 equally spaced teeth (i.e., N=60), and each pulse in the crankshaft position signal 134 may therefore correspond to approximately 6° of crankshaft rotation (360°/60=6°/tooth). In various implementations, one or more of the N teeth may be omitted. For example only, two of the N teeth may be omitted in various implementations. The one or more missing teeth may be used to indicate the completion of a revolution of the crankshaft 118.

The engine 102 outputs torque to a transmission 140. The transmission 140 may include a manual type transmission, an automatic type transmission, an auto-manual type transmission, or another suitable type of transmission. The transmission 140 may output torque to one or more wheels (not shown) via a transmission output shaft 142 and a driveline (not shown).

While the rotational distance between consecutive teeth of the N-toothed wheel 132 should be equal (e.g., 6° in the above example), the rotational distances between consecutive teeth may vary. The variation may be due to, for example, manufacturing tolerances, part-to-part variation, wear, sensor variation, and/or one or more other sources.

An engine control module (ECM) 160 may selectively learn the distance between each pair of consecutive teeth of the N-toothed wheel 132. The ECM 160 determines a position of the crankshaft 118 based on the crankshaft position signal and the distances between the teeth. The ECM 160 monitors the period between consecutive teeth and generates an engine speed based on the period between consecutive teeth and the distance between the teeth. The engine speed at a given crankshaft position corresponds to an instantaneous engine speed (rotational speed of the crankshaft 118) at the crankshaft position. The ECM 160 also monitors the change between consecutive periods (delta period) and may generate an acceleration based on the change in the period.

The ECM 160 stores the delta periods for the cylinder 114 when the crankshaft 118 within a predetermined position range for the cylinder 114. The ECM 160 may store the delta periods for the cylinder 114 for each engine cycle. When the delta periods for the cylinder 114 have been stored for a predetermined number of engine cycles, the ECM 160 may determine whether a stochastic pre-ignition (SPI) event occurred within the cylinder 114 based on a change in the delta period at a given position relative to the delta period at the given position from previous and subsequent firing events of the cylinder 114. The ECM 160 may also determine a level of the SPI event based on a change in the crankshaft position where a peak value of the delta period occurs. SPI events may cause engine damage if not detected and/or not remediated. SPI is different than misfire and knock.

Figure 2:
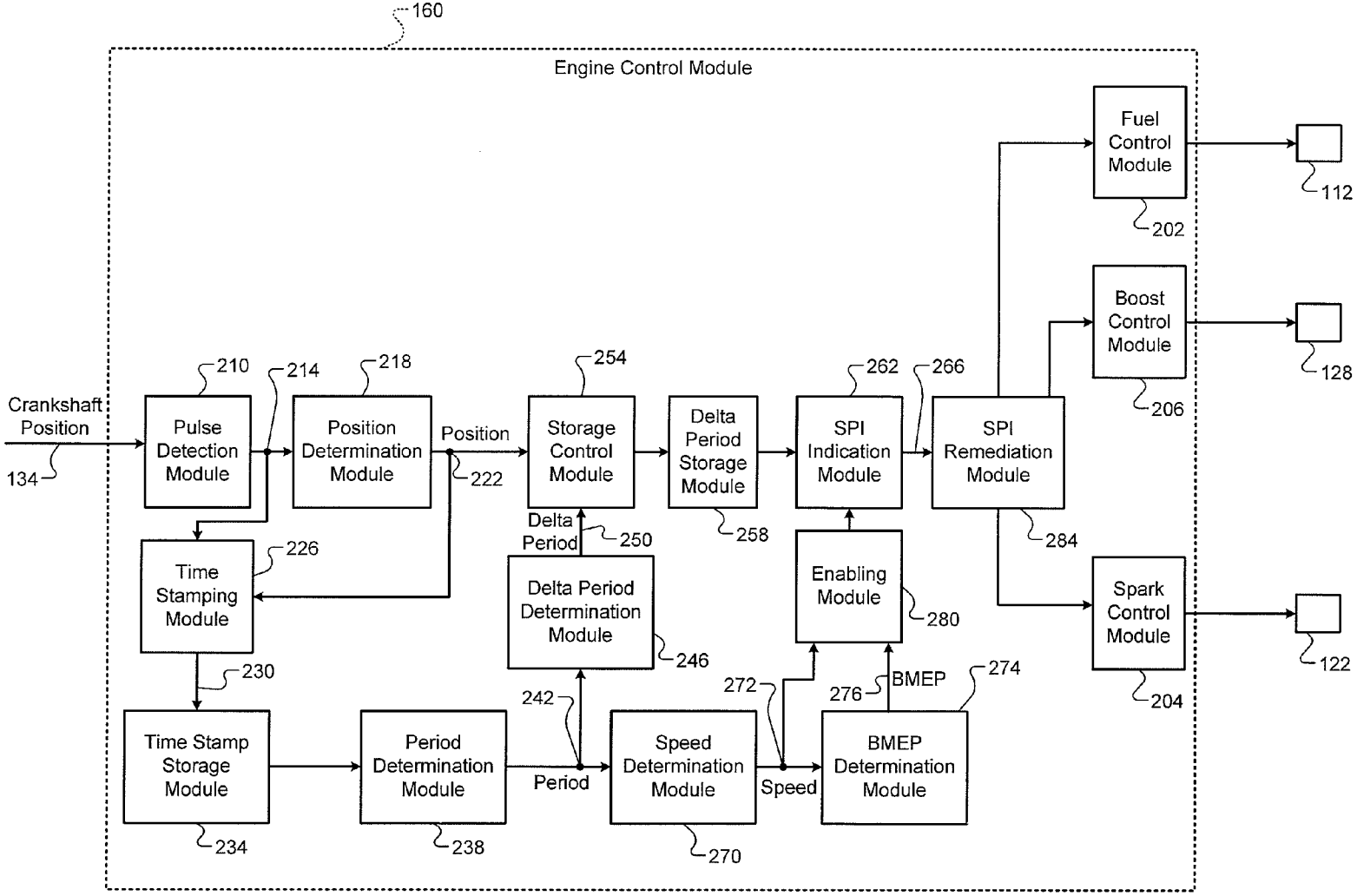
FIG. 2 is a functional block diagram of an example engine control module according to the present disclosure.

Referring now to FIG. 2, a functional block diagram of an example implementation of the ECM 160 is presented. A fuel control module 202 generates a fuel signal, and the fuel actuator module 112 controls fuel injection amount and timing based on the fuel signal. A spark control module 204 may generate a spark signal, and the spark actuator module 122 may control spark timing based on the spark signal. A boost control module 206 may generate a boost signal, and the boost actuator module 128 may control the boost device 127 based on the boost signal.

A pulse detection module 210 receives the crankshaft position signal 134 generated using the crankshaft position sensor 130. The pulse detection module 210 may generate an indicator 214 when a pulse is detected in the crankshaft position signal 134. The pulse detection module 210 may generate an indicator each time that a pulse is detected in the crankshaft position signal 134. The pulse detection module 210 may also indicate whether a pulse indicates that the tooth passed in a forward direction or a reverse direction.

A position determination module 218 may determine a crankshaft position 222 based on the number of pulses detected in the crankshaft position signal 134. The position determination module 218 may determine the crankshaft position 222 further based on whether the teeth pass in the forward direction or the reverse direction. The position determination module 218 may generate the crankshaft position 222 using, for example, a Kalman filter, a Chebyshev filter, a Butterworth type II filter, or another suitable type of filter. The crankshaft position 222 may correspond to an angular position of the crankshaft 118 at a given time.

A time stamping module 226 generates a time stamp 230 when a pulse is detected in the crankshaft position signal 134. The time stamping module 226 generates a time stamp each time that a pulse is detected in the crankshaft position signal 134. The time stamping module 226 may index the timestamps by the crankshaft positions 222 corresponding to the timestamps, respectively, in a time stamp storage module 234. The time stamping module 226 may index the timestamps in the time stamp storage module 234 by engine cycle.

An example table that is illustrative of the data stored in the time stamp storage module 234 is presented below.

| Crankshaft Position 222 | Timestamp 230 |
|---|---|
| $CP_1$ | $T_1$ |
| $CP_2$ | $T_2$ |
| $CP_3$ | $T_3$ |
| ... | ... |
| $CP_M$ | $T_M$ |

$CP_1$ is a first value of the crankshaft position 222 corresponding to a first pulse in the crankshaft position signal 134, $CP_2$ is a second value of the crankshaft position 222 corresponding to a second pulse in the crankshaft position signal 134, $CP_3$ is a third value of the crankshaft position 222 corresponding to a third pulse in the crankshaft position signal 134, and $CP_M$ is an M-th value of the crankshaft position 222 corresponding to an M-th pulse in the crankshaft position signal 134. M is an integer greater than one. $T_1$ is a first time stamp corresponding to the first pulse in the crankshaft position signal 134 (and the first crankshaft position), and $T_2$ is a second time stamp corresponding to the second pulse in the crankshaft position signal 134 (and the second crankshaft position). $T_3$ is a third time stamp corresponding to the third pulse in the crankshaft position signal 134 (and the third crankshaft position), and $T_M$ is an M-th time stamp corresponding to the M-th pulse in the crankshaft position signal 134 (and the M-th crankshaft position).

A period determination module 238 determine a period 242 for the crankshaft position 222 based on the timestamp 230 for the crankshaft position 222 and a timestamp for a last crankshaft position. For example only, the period determination module 238 may set the period 242 equal to the period between the timestamp 230 for the crankshaft position 222 and the timestamp for the last crankshaft position. An example table that is illustrative of the value of the period 242 at various crankshaft positions is presented below.

| Crankshaft Position 222 | Timestamp 230 | Period 242 |
|---|---|---|
| $CP_1$ | $T_1$ | $P_1 = T_1 - T_0$ |
| $CP_2$ | $T_2$ | $P_2 = T_2 - T_1$ |
| $CP_3$ | $T_3$ | $P_3 = T_3 - T_2$ |
| ... | ... | ... |
| $CP_M$ | $T_M$ | $P_M = T_M - T_{M-1}$ |

$P_1$ is the period 242 corresponding to the first crankshaft position ($CP_1$), $P_2$ is the period 242 corresponding to the second crankshaft position ($CP_2$), $P_3$ is the period 242 corresponding to the third crankshaft position ($CP_3$), and $P_M$ is the period 242 corresponding to the M-th crankshaft position ($CP_M$). The period 242 for a given crankshaft position 222 may be used to generate an instantaneous engine speed at the given crankshaft position 222 as discussed further below.

A delta period determination module 246 determines a delta period 250 for the crankshaft position 222 based on the period 242 for the crankshaft position 222 and a period for a last crankshaft position. For example only, the delta period determination module 246 may set the delta period 250 based on a difference between the period 242 for the crankshaft position 222 and the period for the last crankshaft position. An example table that is illustrative of the value of the delta period 250 for various crankshaft positions is presented below.

| Crankshaft Position 222 | Timestamp 230 | Period 242 | Delta Period 250 |
|---|---|---|---|
| $CP_1$ | $T_1$ | $P_1 = T_1 - T_0$ | $DP_1 = P_1 - P_0$ |
| $CP_2$ | $T_2$ | $P_2 = T_2 - T_1$ | $DP_2 = P_2 - P_1$ |
| $CP_3$ | $T_3$ | $P_3 = T_3 - T_2$ | $DP_3 = P_3 - P_2$ |
| ... | ... | ... | ... |
| $CP_M$ | $T_M$ | $P_M = T_M - T_{M-1}$ | $DP_M = P_M - P_{M-1}$ |

$DP_1$ is the delta period 250 corresponding to the first crankshaft position ($CP_1$), $DP_2$ is the delta period 250 corresponding to the second crankshaft position ($CP_2$), $DP_3$ is the delta period 250 corresponding to the third crankshaft position ($CP_3$), and $DP_M$ is the delta period 250 corresponding to the M-th crankshaft position ($CP_M$). The delta period 250 for a given crankshaft position 222 may be used to generate an instantaneous (crankshaft) acceleration at the given crankshaft position 222.

A storage control module 254 selectively stores the delta period 250 with the corresponding crankshaft position 222 within a delta period storage module 258. The storage control module 254 associates the delta period 250 with the cylinder 114 within the delta period storage module 258. The storage control module 254 also associates the delta period 250 with an engine cycle during which the crankshaft position 222 occurred. In this manner, the delta period storage module 258 includes cylinder and engine cycle specific delta periods.

The storage control module 254 may determine whether to store the delta period 250 within the delta period storage module 258 for the cylinder 114 and the present engine cycle based on the corresponding crankshaft position 222 and a predetermined crankshaft position range for the cylinder 114. The storage control module 254 may store the delta period 250 in the delta period storage module 258 when the crankshaft position 222 is within the predetermined crankshaft position range for the cylinder 114. For example only, the predetermined crankshaft position range may be between approximately 20 degrees (°) before the piston reaches the TDC position (BTDC) within the cylinder 114 and approximately 40° after the piston reaches the TDC position (ATDC). An example table illustrating the data stored in the delta period storage module 258 is provided below.

| Engine Cycle | Cylinder | Crankshaft Position 222 | Delta Period 250 |
|---|---|---|---|
| 1 | 112 | $CP_1$ | $DP_1$ |
| 1 | 112 | $CP_2$ | $DP_2$ |
| 1 | 112 | $CP_3$ | $DP_3$ |
| ... | 112 | ... | ... |
| 2 | 112 | $CP_1$ | $DP_1$ |
| 2 | 112 | $CP_2$ | $DP_2$ |
| 2 | 112 | $CP_3$ | $DP_3$ |
| ... | 112 | ... | ... |
| 3 | 112 | $CP_1$ | $DP_1$ |
| 3 | 112 | $CP_2$ | $DP_2$ |
| 3 | 112 | $CP_3$ | $DP_3$ |
| ... | 112 | ... | ... |

Figure 3:
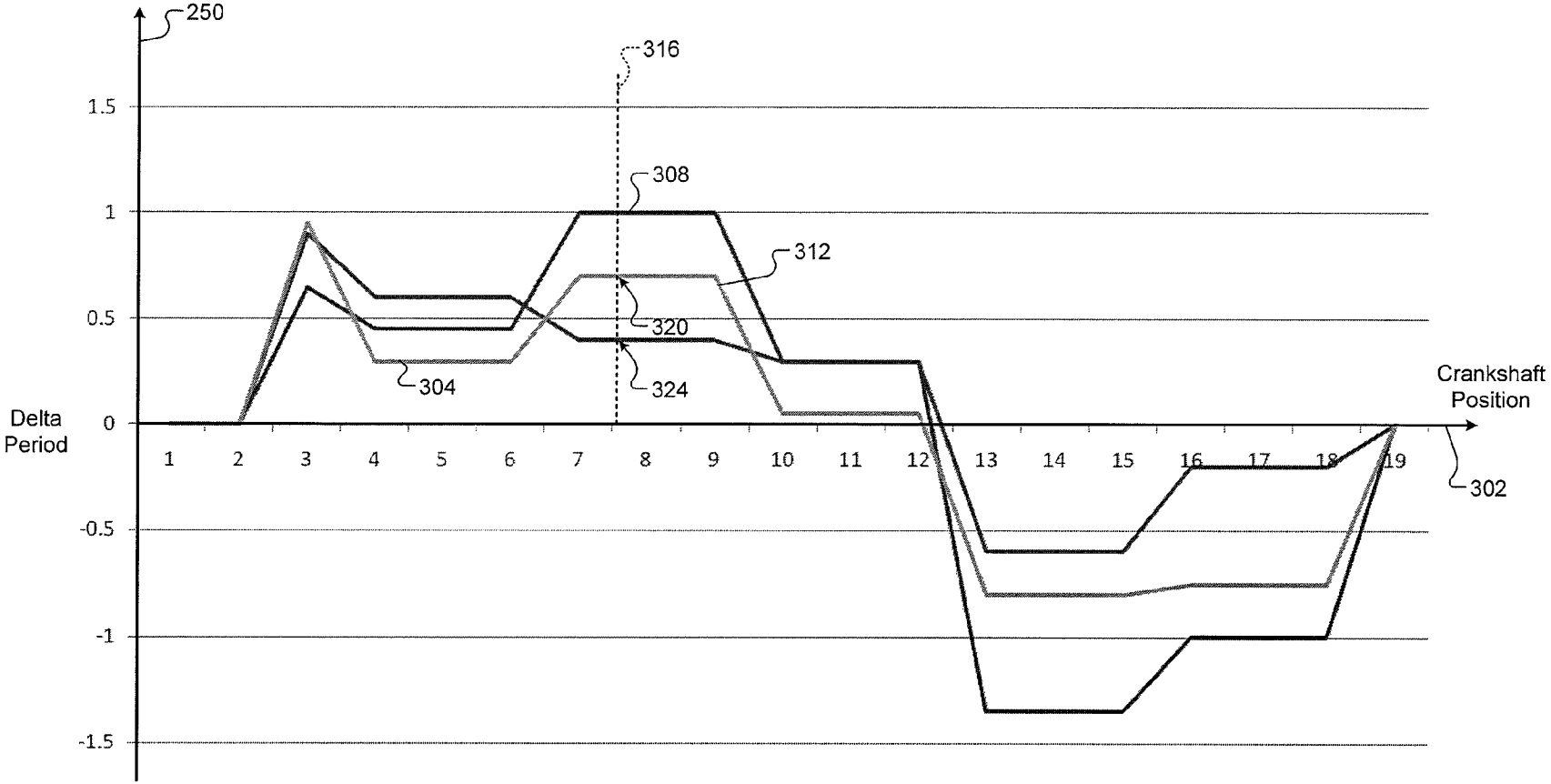
FIG. 3 is an example graph of change in period (delta period) as a function of crankshaft position.

FIG. 3 includes an example graph of the delta period 250 plotted as a function of a crankshaft position 302 for three consecutive engine cycles. Referring now to FIGS. 2 and 3, example trace 304 tracks the delta period 250 as a function of the crankshaft position 302 during a last completed engine cycle (n). Example trace 308 tracks the delta period 250 as a function of the crankshaft position 302 during a second to last engine cycle (n−1). Example trace 312 tracks the delta period 250 as a function of the crankshaft position 302 during an engine cycle that immediately preceded (n−2) the second to last engine cycle (n−1).

An SPI indication module 262 selectively generates an SPI indicator 266 based on the delta periods for the last three engine cycles (n, n−1, and n−2). The SPI indicator 266 indicates whether an SPI event occurred within the cylinder 114 during the n−1 engine cycle.

The SPI indication module 262 may determine average delta periods for the crankshaft positions within the predetermined range, respectively. The SPI indication module 262 may determine the average delta periods for the crankshaft positions based on the delta periods for the crankshaft positions, respectively, of the n and n−2 engine cycles. For example only, for a given crankshaft position 316, the SPI indication module 262 may determine the average delta period for the crankshaft position 316 based on the average of the delta period for the n engine cycle 320 and the delta period for the n−2 engine cycle 324. The SPI indication module 262 may determine the average delta period for each of the other crankshaft positions similarly. An example table of average delta periods is presented below.

| Crankshaft Position 222 | Average Delta Period |
|---|---|
| $CP_1$ | $ADP_1 = \frac{DP_1(n-2) + DP_1(n)}{2}$ |
| $CP_2$ | $ADP_2 = \frac{DP_2(n-2) + DP_2(n)}{2}$ |
| $CP_3$ | $ADP_3 = \frac{DP_3(n-2) + DP_3(n)}{2}$ |
| . . . | |
| $CP_M$ | $ADP_M = \frac{DP_M(n-2) + DP_M(n)}{2}$ |

$ADP_1$ is the average delta period for the first crankshaft position 222, $ADP_2$ is the average delta period for the second crankshaft position 222, $ADP_3$ is the average delta period for the third crankshaft position 222, and $ADP_M$ is the average delta period for the M-th crankshaft position 222. $DP_1(n-2)$ is the delta period 250 for the first crankshaft position of the n−2 engine cycle, $DP_1(n)$ is the delta period 250 for the first crankshaft position of the n engine cycle, $DP_2(n-2)$ is the delta period 250 for the second crankshaft position of the n−2 engine cycle, and $DP_2(n)$ is the delta period 250 for the second crankshaft position of the n engine cycle. $DP_3(n-2)$ is the delta period 250 for the third crankshaft position of the n−2 engine cycle, $DP_3(n)$ is the delta period 250 for the third crankshaft position of the n engine cycle, $DP_M(n-2)$ is the delta period 250 for the M-th crankshaft position of the n−2 engine cycle, and $DP_M(n)$ is the delta period 250 for the M-th crankshaft position of the n engine cycle.

The SPI indication module 262 may determine delta period differences for the crankshaft positions within the predetermined range, respectively. The SPI indication module 262 may determine the delta period differences for the crankshaft positions based on the delta periods and the average delta periods for the crankshaft positions, respectively. For example only, for a given crankshaft position, the SPI indication module 262 may determine the delta period difference based on the difference between the average delta period for the crankshaft position and the delta period 250 for the crankshaft position of the n−1 engine cycle. The SPI indication module 262 may determine the delta period difference for each other crankshaft position similarly. An example table of delta period differences is presented below.

| Crankshaft Position 222 | Delta Period Difference |
|---|---|
| $CP_1$ | $DPD_1 = DP_1(n-1) - ADP_1$ |
| $CP_2$ | $DPD_2 = DP_2(n-1) - ADP_2$ |
| $CP_3$ | $DPD_3 = DP_3(n-1) - ADP_3$ |
| . . . | |
| $CP_M$ | $DPD_M = DP_M(n-1) - ADP_M$ |

$DPD_1$ is the delta period difference for the first crankshaft position, $DPD_2$ is the delta period difference for the second crankshaft position, $DPD_3$ is the delta period difference for the third crankshaft position, and $DPD_M$ is the delta period difference for the M-th crankshaft position. $DP_1$ is the delta period for the first crankshaft position of the n−1 engine cycle, $DP_2$ is the delta period for the second crankshaft position of the n−1 engine cycle, $DP_3$ is the delta period for the third crankshaft position of the n−1 engine cycle, and $DP_M$ is the delta period for the M-th crankshaft position of the n−1 engine cycle.

The SPI indication module 262 may determine whether an SPI event occurred within the cylinder 114 during the n−1 engine cycle based on one or more of the delta period differences. For example only, the SPI indication module 262 may determine that an SPI event occurred within the cylinder 114 during the n−1 engine cycle when one or more of the delta period differences is greater than a predetermined value. Written conversely, the SPI indication module 262 may determine that an SPI event did not occur within the cylinder 114 during the n−1 engine cycle when the delta period differences are all less than the predetermined value. The predetermined value may be calibratable and may be set, for example, to correspond to a change in pressure within the cylinder 114 of approximately 3.0 megapascal (MPa) or another suitable value. The SPI indication module 262 may set the SPI indicator 266 to an active state when an SPI event occurred. The SPI indication module 262 may set the SPI indicator 266 to an inactive state when an SPI event did not occur.

When an SPI event occurred, the SPI indication module 262 may also determine and indicate a level for the SPI event. The SPI indication module 262 may determine a peak pressure for the n−1 engine cycle. The peak pressure may correspond to the delta period 250 for the n−1 engine cycle where a greatest pressure occurred within the cylinder 114. The SPI indication module 262 may determine the level of the SPI event based on the crankshaft position 222 corresponding to the delta period 250 with the largest magnitude.

Figure 4:
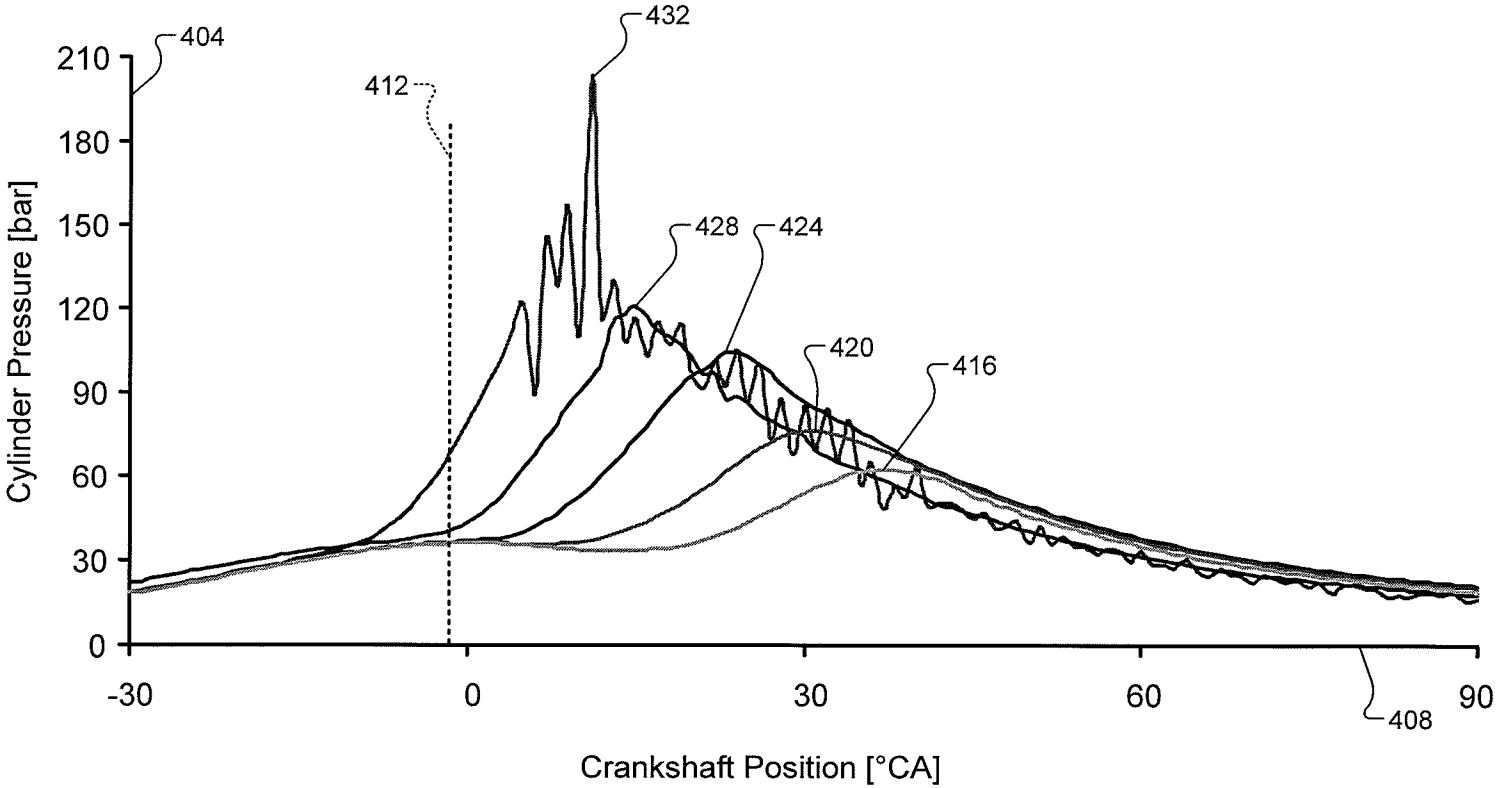
FIG. 4 is an example graph of cylinder pressure as a function of crankshaft position.

Referring now to FIG. 4, an example graph of cylinder pressure 404 as a function of crankshaft position 408 is presented. Spark timing for each example trace occurs at approximately crankshaft position 412. Example trace 416 tracks the cylinder pressure 404 as a function of the crankshaft position 408 during an engine cycle that sustained a minimum cylinder pressure. Example trace 420 tracks the cylinder pressure 404 as a function of the crankshaft position 408 during an engine cycle that sustained an average cylinder pressure. Example trace 424 tracks the cylinder pressure 404 as a function of the crankshaft position 408 during an engine cycle that sustained a maximum cylinder pressure.

Example trace 428 tracks the cylinder pressure 404 as a function of the crankshaft position 408 during an engine cycle during which an SPI event occurred and knock did not occur. Example trace 432 tracks the cylinder pressure 404 as a function of the crankshaft position 408 during an engine cycle during which an SPI event occurred and knock occurred. As illustrated in FIG. 4, the peak cylinder pressure changes (advances in FIG. 4) as the cylinder pressure conditions increasingly indicate that an SPI event occurred.

Referring again to FIG. 2, SPI events may occur when the engine speed is less than a predetermined speed and an engine load parameter is greater than a predetermined load value. An engine speed determination module 270 may determine an engine speed 272 for the crankshaft position 222 based on the period 242 and the distance between the two teeth corresponding to the crankshaft position 222 and the last crankshaft position. The engine speed 272 may correspond to an instantaneous engine speed at the crankshaft position 222. The engine speed determination module 270 may generate the engine speed 272 using, for example, a Kalman filter, a Chebyshev filter, a Butterworth type II filter, or another suitable type of filter.

A braking mean effective pressure (BMEP) may be used as the engine load parameter in various implementations. Other suitable engine load parameters may be used in other implementations. A BMEP determination module 274 determines a BMEP 276 based on the engine speed 272. For example only, an indicated work for a combustion cycle of the cylinder 114 may be generated based on squares of two or more engine speeds at predetermined crankshaft positions of the combustion cycle, respectively. An indicated mean effective pressure (IMEP) of the combustion cycle of the cylinder 114 may be generated based on the indicated work and the displacement volume of the engine 102. A BMEP can be determined based on the IMEP.

An enabling module 280 selectively enables and disables the SPI indication module 262 based on the engine speed 272 and the BMEP 276 over the n−2, n−1, and n engine cycles. For example only, the enabling module 280 may disable the SPI indication module 262 when the engine speed 272 is greater than the predetermined speed at least once during the n−2, n−1, and n engine cycles and/or the BMEP 276 is less than the predetermined load value at least once during the n−2, n−1, and n engine cycles. In this manner, the enabling module 280 prevents the SPI indication module 262 from indicating that an SPI event occurred when the engine speed 272 was greater than the predetermined speed and/or the BMEP 276 was greater than the predetermined load value.

Conversely, the enabling module 280 may enable the SPI indication module 262 when the engine speed 272 remains less than the predetermined speed during the n−2, n−1, and n engine cycles and the BMEP 276 remains greater than the predetermined load value during the n−2, n−1, and n engine cycles. For example only, the predetermined speed may be approximately 3000 revolutions per minute (rpm) or another suitable speed, and the predetermined load value may be approximately 13 bar BMEP or another suitable value.

An SPI remediation module 284 selectively adjusts at least one engine operating parameter in response to the SPI indication module 262 indicating that an SPI event occurred. For example only, when an SPI event has occurred, the SPI remediation module 284 may command the fuel control module 202 to increase the amount of fuel provided to provide a richer air/fuel mixture. The SPI remediation module 284 may command the fuel control module 202 to increase the amount of fuel provided to the cylinder 114. Additionally or alternatively, the SPI remediation module 284 may command the boost control module 206 to reduce the amount of boost provided by the boost device 127. Additionally or alternatively, the SPI remediation module 284 may command the spark control module 204 to disable knock control and to set the spark timings using a predetermined set of optimal spark timings. The SPI remediation module 284 may additionally or alternatively take one or more other suitable remedial actions.

Figure 5:
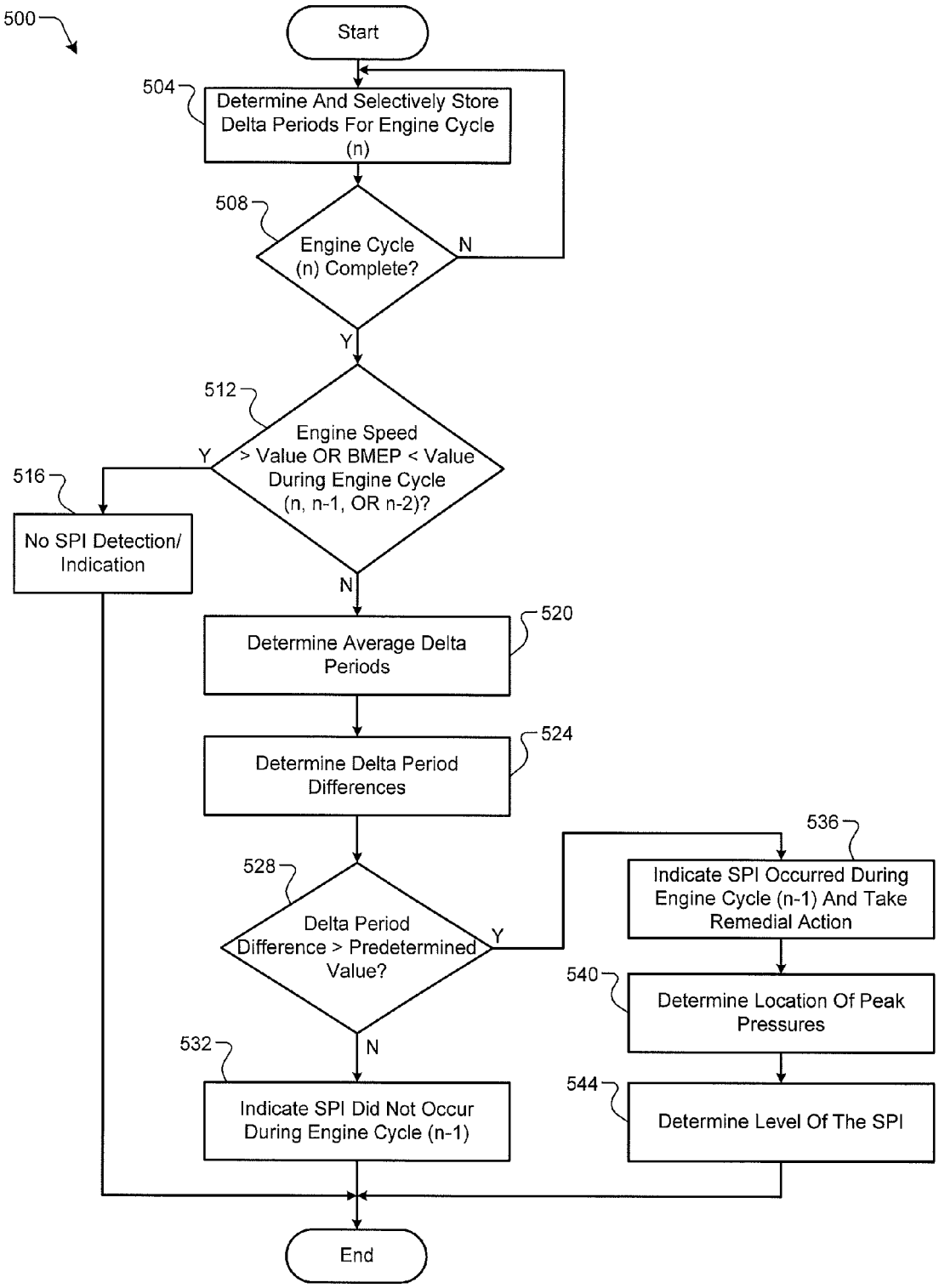
FIG. 5 is a flowchart depicting an example method of detecting and indicating whether a stochastic pre-ignition (SPI) event occurred within a cylinder according to the present disclosure.

Referring now to FIG. 5, a flowchart depicting an example method 500 of detecting and indicating whether an SPI event occurred is presented. Control may begin with 504 where control determines and selectively stores the delta periods for the n (last) engine cycle.

Control determines whether the n engine cycle is complete at 508. If so, control proceeds with 512. If false returns to 504. At 512, control determines whether the engine speed 272 was greater than the predetermined speed and/or the BMEP 276 was less than the predetermined load value at least once during the n, n−1, or n−2 engine cycles. If true, control may disable SPI event detection and indication at 516, and control may end. If false, control may continue with 520.

Control determines the average delta periods at 520. Control determines the average delta period for a crankshaft position based on the average of the delta period for the crankshaft position of the n engine cycle and the delta period for the crankshaft position of the n−2 engine cycle. Control determines the delta period differences at 524. Control determines the delta period difference for a crankshaft position based on a difference between the average delta period for the crankshaft position and the delta period for the crankshaft position of the n−1 engine cycle.

Control determines whether one or more of the delta period differences are greater than the predetermined value at 528. If false, control may indicate that an SPI event did not occur during the n−1 engine cycle at 532, and control may end. If true, control may continue with 536. The predetermined value may be calibratable and may be set, for example, to correspond to a change in pressure within the cylinder 114 of approximately 3.0 megapascal (MPa) or another suitable value.

At 536, control may indicate that an SPI event occurred during the n−1 engine cycle and take remedial action. Remedial actions may include, for example, providing a fuel-rich air/fuel mixture to the cylinder 114, decreasing boost, commanding use of the predetermined set of optimum spark timings, and/or one or more other suitable remedial actions.

At 540, control may determine the crankshaft position where the peak pressure occurred during the n, n−1, and n−2 engine cycles. Control may determine a level of the SPI event based on the crankshaft position where the peak pressure occurred during the n−1 engine cycle at 544. Control may determine the level of the SPI event further based on one or more other crankshaft positions where peak pressures occurred or should occur. Control may then end. While control is shown as ending, FIG. 5 may be illustrative of one control loop and control may return to 504.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for a vehicle, comprising:

a time stamping module that generates first, second, and third timestamps when a crankshaft of an engine is in first, second, and third crankshaft positions during a first engine cycle, respectively, that generates fourth, fifth, and sixth timestamps when the crankshaft is in the first, second, and third crankshaft positions during a second engine cycle, respectively, and that generates seventh, eighth, and ninth timestamps when the crankshaft is in the first, second, and third crankshaft positions during a third engine cycle, respectively;

a period determination module that determines a first period between the first and second timestamps, that determines a second period between the second and third timestamps, that determines a third period between the fourth and fifth timestamps, that determines a fourth period between the fifth and sixth timestamps, that determines a fifth period between the seventh and eighth timestamps, and that determines a sixth period between the eighth and ninth timestamps;

a delta period determination module that determines a first difference between the first period and the second period, that determines a second difference between the third period and the fourth period, and that determines a third difference between the fifth period and the sixth period;

a stochastic pre-ignition (SPI) indication module that determines an average of the second and third differences and that selectively indicates that an SPI event occurred within a cylinder of the engine based on a comparison of a fourth difference between the average and the first difference with a predetermined value; and an SPI remediation module that selectively adjusts at least one engine operating parameter in response to the SPI indication module indicating that the SPI event occurred within the cylinder.

2. The system of claim 1 wherein:

the second engine cycle follows the first engine cycle; and the third engine cycle follows the second engine cycle.

3. The system of claim 1 wherein the SPI indication module selectively indicates that the SPI event occurred within the cylinder when the fourth difference between the average and the first difference is greater than the predetermined value.

4. The system of claim 1 further comprising an enabling module that enables the SPI indication module when an engine speed is less than a predetermined speed and a braking mean effective pressure (BMEP) is greater than a predetermined BMEP and that disables the SPI indication module when at least one of the engine speed is greater than the predetermined speed and the BMEP is less than the predetermined BMEP.

5. The system of claim 1 wherein the SPI remediation module decreases output of a boost device in response to the SPI indication module indicating that the SPI event occurred within the cylinder.

6. The system of claim 5 wherein the SPI remediation module provides a fuel-rich air/fuel mixture to the cylinder in response to the SRI indication module indicating that the SPI event occurred within the cylinder.

7. A method for a vehicle, comprising:

generating first, second, and third timestamps when a crankshaft of an engine is in first, second, and third crankshaft positions during a first engine cycle, respectively;

generating fourth, fifth, and sixth timestamps when the crankshaft is in the first, second, and third crankshaft positions during a second engine cycle, respectively;

generating seventh, eighth, and ninth timestamps when the crankshaft is in the first, second, and third crankshaft positions during a third engine cycle, respectively;

determining a first period between the first and second timestamps;

determining a second period between the second and third timestamps;

determining a third period between the fourth and fifth timestamps;

determining a fourth period between the fifth and sixth timestamps;

determining a fifth period between the seventh and eighth timestamps;

determining a sixth period between the eighth and ninth timestamps;

determining a first difference between the first period and the second period;

determining a second difference between the third period and the fourth period;

determining a third difference between the fifth period and the sixth period;

determining an average of the second and third differences;

selectively indicating that a stochastic pre-ignition (SPI) event occurred within a cylinder of the engine based on a comparison of a fourth difference between the average and the first difference with a predetermined value; and selectively adjusting at least one engine operating parameter in response to the indication that the SPI event occurred within the cylinder.

8. The method of claim 7 wherein the second engine cycle follows the first engine cycle, and wherein the third engine cycle follows the second engine cycle.

9. The method of claim 7 further comprising selectively indicating that the SPI event occurred within the cylinder when the fourth difference between the average and the first difference is greater than the predetermined value.

10. The method of claim 7 further comprising:

enabling the selectively indicating when an engine speed is less than a predetermined speed and a braking mean effective pressure (BMEP) is greater than a predetermined BMEP; and disabling the selectively indicating when at least one of the engine speed is greater than the predetermined speed and the BMEP is less than the predetermined BMEP.

11. The method of claim 7 further comprising decreasing output of a boost device in response to the indication that the SPI event occurred within the cylinder.

12. The method of claim 11 further comprising providing a fuel-rich air/fuel mixture to the cylinder in response to the indication that the SPI event occurred within the cylinder.

* * * * *